310-14 SR
FIP8502 XR 4,381,181

United States Patent [19]
Clegg

[11] 4,381,181
[45] Apr. 26, 1983

[54] SOLENOID-ACTUATED CENTRIFUGAL PUMP AND METHOD

[76] Inventor: Warren P. Clegg, 630 Augusta, Houston, Tex. 77057

[21] Appl. No.: 177,139

[22] Filed: Aug. 11, 1980

Related U.S. Application Data

[63] Continuation of Ser. No. 914,411, Jun. 12, 1978, abandoned.

[51] Int. Cl.[3] ..... F04B 17/04
[52] U.S. Cl. ..... 417/423 R; 310/14
[58] Field of Search ..... 417/415, 423 R, 424, 417/53; 310/14, 46, 12; 415/53 R, 52, 213 R; 137/624.13

[56] References Cited

U.S. PATENT DOCUMENTS

| | | | |
|---|---|---|---|
| 3,496,871 | 2/1970 | Stengel | 417/410 |
| 3,653,787 | 4/1972 | Commarmot | 417/415 |
| 3,836,289 | 9/1974 | Wolford et al. | 417/415 |
| 3,894,817 | 7/1975 | Majors et al. | 417/413 |
| 4,047,852 | 9/1977 | O'Connor et al. | 417/415 |
| 4,058,960 | 11/1977 | Moushovich et al. | 137/624.13 X |
| 4,062,421 | 12/1977 | Weber | 310/14 X |

*Primary Examiner*—Richard E. Gluck
*Attorney, Agent, or Firm*—Bard, Groves, Sroufe & Bishop

[57] ABSTRACT

A pump for moving conductive or non-conductive liquids having a closed loop duct with an inlet and an outlet. An impeller is located within the duct and includes a plurality of serially connected iron cores arranged for rotation within the duct. Movement of the cores within the duct is effected by a plurality of solenoids arranged externally and concentrically of the duct. Control means in the form of sensors actuate and de-actuate one or more of the solenoids. A method for pumping discrete and separated portions of fluid along a path of confinement is also set forth herein.

6 Claims, 15 Drawing Figures

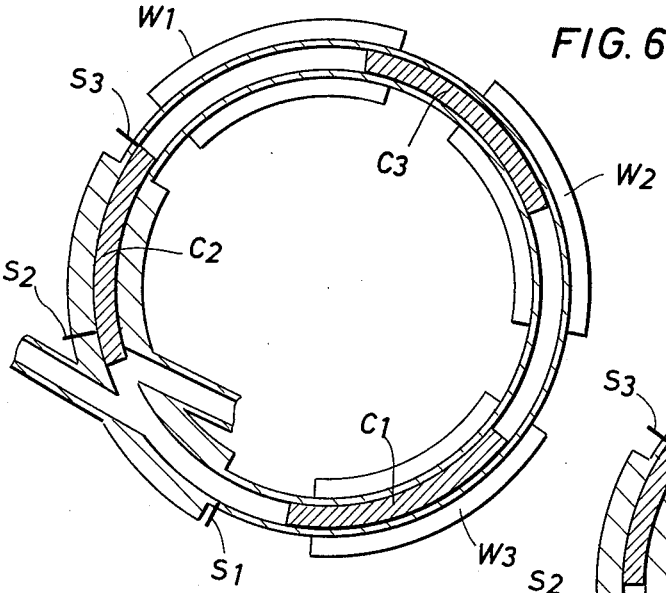
FIG. 6
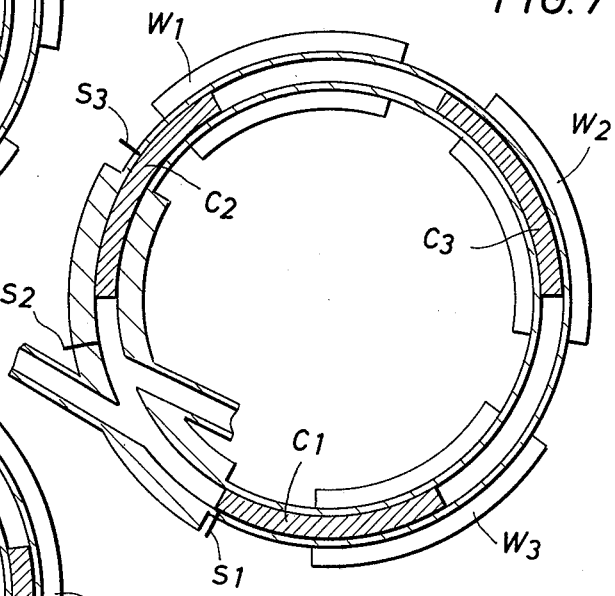
FIG. 7
FIG. 8
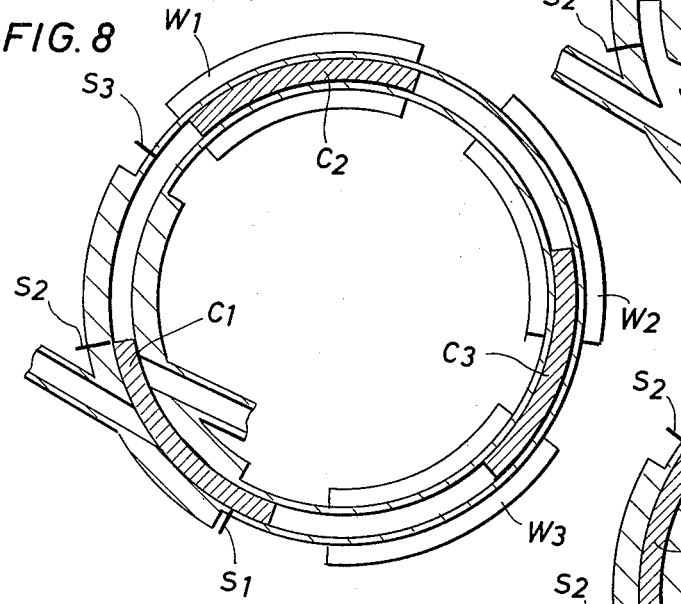
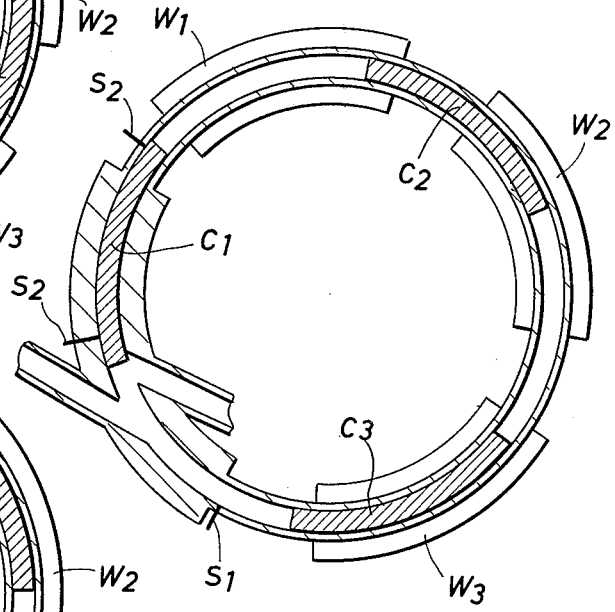
FIG. 9
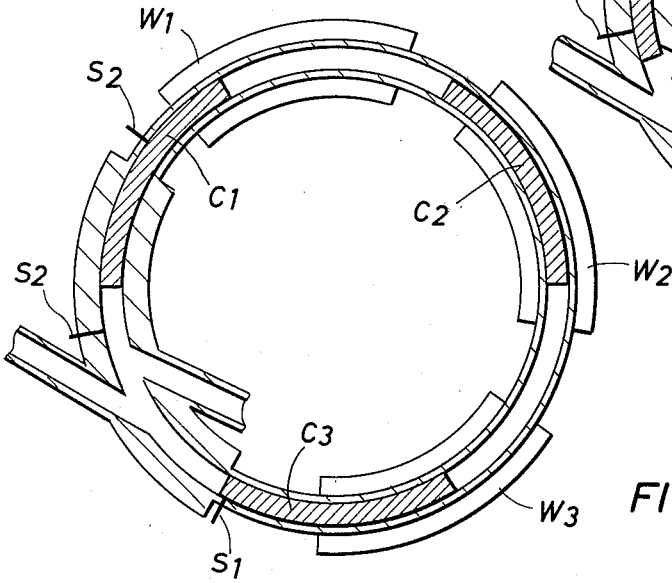
FIG. 10

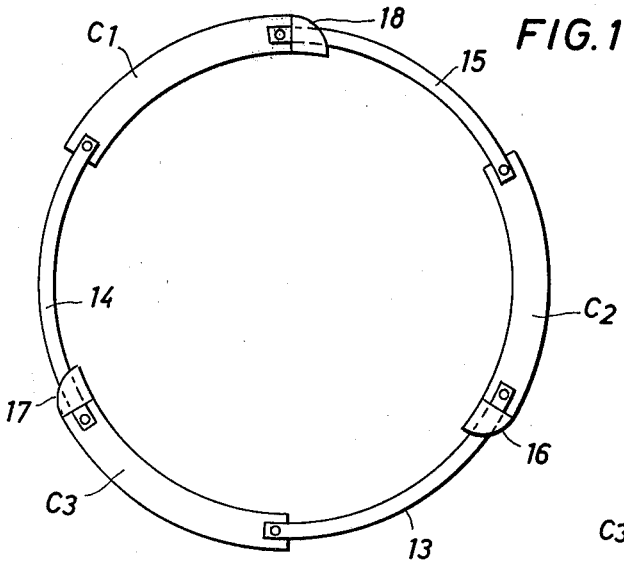
FIG. 11
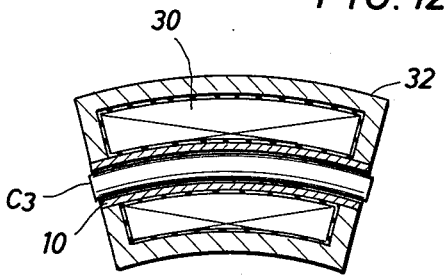
FIG. 12
FIG. 13
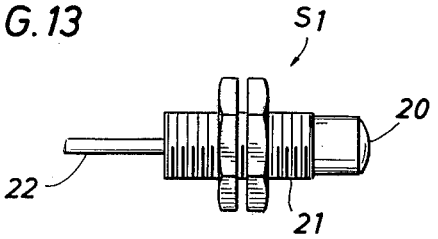
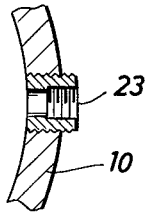
FIG. 14
FIG. 15
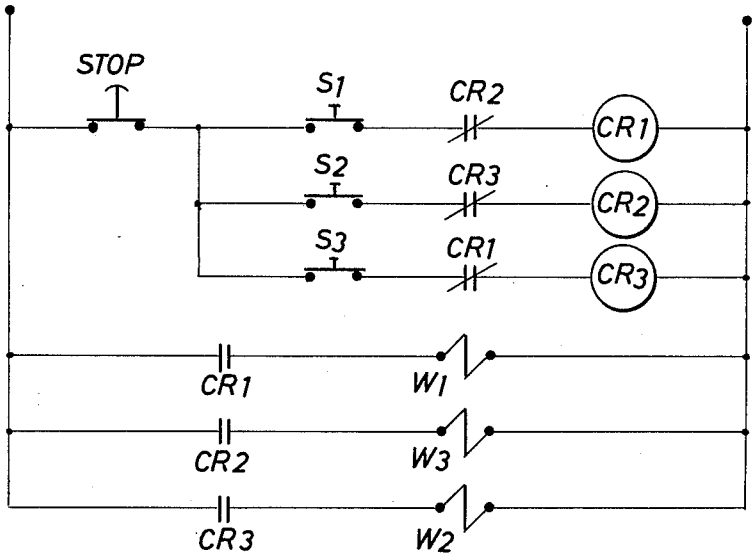

SOLENOID-ACTUATED CENTRIFUGAL PUMP AND METHOD

This is a continuation application Ser. No. 914,411 filed on June 12, 1978, now abandoned.

BACKGROUND OF THE INVENTION

This invention relates to apparatus and method for transferring liquids, and more particularly to centrifugal pump apparatus and method for transferring raw materials, materials in the state of manufacture, and finished products, in liquid form or in a liquid mixture or suspension, as well as for services relating to water supply, boiler feed, condenser circulation, and condensate return.

It is well known that the centrifugal pump is the type most widely used in the chemical industry for transferring liquids. The primary advantages of a centrifugal pump are simplicity, low cost, uniform non-pulsating flow, small floor space, low maintenance, and quiet operation. In its simplest form, the centrifugal pump consists of an impeller rotating within a casing. The impeller consists of a number of blades mounted on a shaft that projects outside the casing. The casing consists of a chamber in which the impeller rotates and is provided with an inlet and an outlet for the liquid being pumped. Power from an outside source is applied to the shaft thus rotating the impeller within the stationary casing. In revolving, the impeller produces a reduction in pressure causing liquid to flow into the impeller from the inlet, and forced from the outlet at an increased tangential velocity which is changed to pressure head at the outlet of the pump.

However well the performance of a centrifugal pump, special problems of sealing the centrifugal pump are inherent. Since a rotating shaft is displaced radially when in operation in varying amounts depending upon the load transmitted, seals must be provided to prevent leakage. Current practice demands that packing boxes be constructed to accommodate both packing and mechanical seals. However, the use of packing results in the continuous escape of a small amount of liquid past the seal since its operation depends upon the maintenance of wetted surfaces to minimize heat generation. Mechanical seals, on the other hand, cannot be adjusted without shutting down the pump for maintenance.

This invention relates to an improved pumping apparatus in the form of a solenoid-actuated centrifugal pump. The preferred embodiment is in the form of a closed duct having an iron core impeller propelled therein by means of a solenoid and wherein movement of the iron core impeller within the duct does not necessitate the need for supporting seals, bearings, or packings, and thus avoiding the complex and cumbersome constructions inherent in prior art pumps of the centrifugal type.

There is depicted and described in U.S. Pat. No. 2,915,973, one or more embodiments of a sealess centrifugal-type pump having an arcuately shaped liquid conducting conduit closed except for an inlet and an outlet, and with magnets movable along the conduit. Liquid metal enters the arcuate conduit and the movement of the magnets along the conduit creates forces which act on the liquid metal in the conduit and move the liquid metal through the conduit. The pump of U.S. Pat. No. 2,915,973, will convey liquid and without employing seals, packing, and bearings, for the pump housing. On the other hand, the pump of said patent is subject to disadvantages that limit its practical value. In the first place, it is effective for pumping liquid metal but is completely useless for pumping any other non-conductive liquid. In the second place, it relies upon externally mounted magnets as the driving force and does not contain within the fluid conducting conduit itself any impeller for increasing the tangential velocity of the liquid therein.

These disadvantages of the prior art, and especially the aforementioned U.S. Pat. No. 2,915,973, are overcome with the present invention, and commercially acceptable embodiments of a centrifugal pump and the like are herein provided which are not only fully capable of pumping liquids under most operating conditions but which are also fully capable of other tasks completely beyond the capabilities of the pump of the aforesaid patent, such as pumping non-conductive liquids. More particularly, however, the embodiments of the present invention are capable of operation with a much higher efficiency.

SUMMARY OF THE INVENTION

This invention is for an improved centrifugal pump or the like, and more particularly relates to an improved solenoid-actuated centrifugal pump. It includes a closed fluid conducting conduit having an inlet and an outlet. It preferably includes within the conduit or duct an impeller which consists of a plurality of serially connected iron cores arranged for rotation within the duct. More particularly, solenoid means are arranged in surrounding relationship to the duct and function as the driving force for rotating the iron core impeller within the liquid conducting duct. Control means, preferably in the form of inductive proximity sensors, are arranged circumferentially about the duct and act to energize and de-energize the solenoids in a predetermined sequence.

In one particularly ideal embodiment of the present invention, an annular duct or conduit is provided which includes an inlet for feeding liquid to the duct, and an outlet for discharging and conveying liquid from the duct. An impeller is located within the duct coaxially therewith and is constituted by three iron core elements spaced equidistantly one from the other. An assembly/-disassembly housing is provided adjacent the inlet and outlet portions of the duct and three solenoids are located concentrically and externally of the duct. The housing portion of the assembly has associated therewith three inductive proximity sensors for controlling the action of the solenoids.

In another particularly ideal embodiment of the present invention, a method is disclosed for driving a fluid along a generally circular path of confinement and which method generally consists of the steps of passing a first discrete quantity of said fluid along a tangential entry path and into said circular path, passing a second separated discrete quantity of said fluid along said entry path and into said circular path to drive said first quantity of fluid to a first driving location along said circular path, passing a third separated discrete quantity of said fluid along said entry path and into said circular path while applying an external driving force to said first quantity to move said first quantity to a second driving location along said path and while also driving said second quantity to said first driving location, passing said third quantity to said first driving location while applying said force to said second quantity to move said second quantity to said second location and applying said force to said third quantity to drive said third quantity from said circular path and along a tangential exit path.

In its broadest concept, any type of an electromagnet may be employed for purposes of the present invention to rotate the iron core impeller. As is well-known, an electromagnet produces a magnetic field by an electric current. The core is usually made of soft iron or mild steel. Electromagnets may have the form of simple solenoids, iron-clad solenoids. plunger electromagnets, external armatured electromagnets, and lifting magnets. However, a solenoid is cheaper, and simpler in construction and is therefore more suitable for a pump in accordance with the concepts and apparatus of the present invention.

Accordingly it is a feature to employ a solenoid as the driving force having characteristics especially suitable for such purposes. For example, as is known, a solenoid is a winding of insulated conductor wound helically into a coil and provided with a movable iron rod or bar called a plunger. When the coil is energized, the iron rod or core becomes magnetized and the mutual action of the field in the solenoid on the poles created on the plunger causes the plunger to move within the solenoid. This force becomes zero when the magnetic centers of the plunger or core and the solenoid coincide. If a load is attached to the plunger, work will be done until the force to be overcome is equal to the force that the solenoid exerts on the plunger. The maximum uniform pull occurs when the end of the plunger is at the center of the solenoid. The pull is due to the attraction between the plunger and the winding. Pull and therefore efficiency may be increased by employing an iron-clad solenoid in which an iron return path is provided for the flux. In the open-ended solenoid of the present invention, the plunger or core element comes to equilibrium when its middle is at the middle of the winding, thus providing a magnetic cushion effect.

It is therefore a feature of the present invention to provide a solenoid as the driving force for the impeller of a centrifugal pump, and wherein the impeller constitutes the plunger of the solenoid unit.

It is another feature of the herein described invention to provide a centrifugal-type of pump constructed to function and operate and without the necessity of providing seals, bearings, and packings for the pump housing.

It is a further feature of the present invention to provide a solenoid-actuated centrifugal pump including an iron-core impeller for increasing the tangential velocity of fluids within the pump casing whereby conductive as well as non-conductive liquids may be acted upon.

These and other features and advantages of the present invention will become apparent from the following detailed description, wherein reference is made to the figures in the accompanying drawings.

IN THE DRAWINGS

FIGS. 2–10 are views similar to that of FIG. 1 but illustrating the apparatus in its sequence of movement of the iron core element C3 and 360° revolution;

FIG. 11 is a top view of the iron core impeller element of the apparatus of FIG. 1;

FIG. 12 is a detailed view of the curvilinear solenoid employed in the apparatus of FIG. 1;

FIG. 13 is a pictorial representation of one of the inductive proximity sensors of the apparatus of FIG. 1 and illustrating the details of construction thereof;

FIG. 14 is a partial view of the duct of FIG. 1 and illustrating the mechanical connection for receiving the inductive proximity sensors of the present invention; and FIG. 15 is a schematic circuit diagram of the various components of the apparatus of FIG. 1.

DETAILED DESCRIPTION

Figure 1:
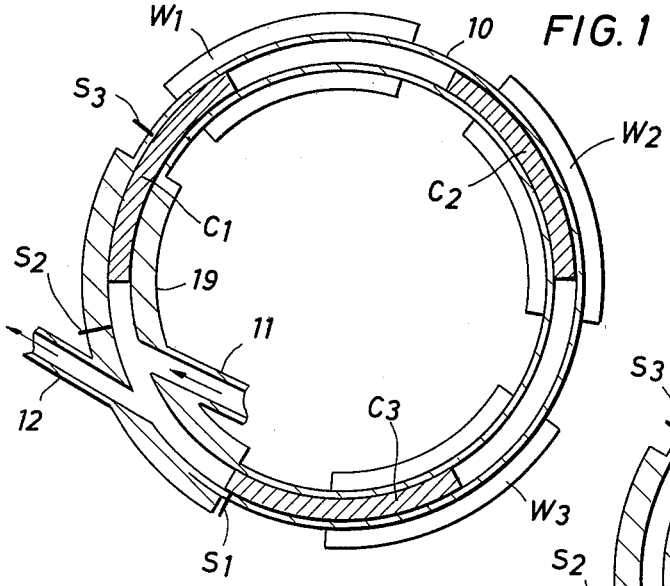
FIG. 1 is a pictorial top view, partly in cross-section, showing the pump apparatus of the present invention and wherein the mechanical features and configuration of the apparatus are set forth.

Referring now to FIG. 1, there is therein depicted and illustrated a solenoid-actuated centrifugal pump of the present invention and including liquid conveying duct or conduit means 10. Duct 10 is formed in the fashion of a closed loop and is provided with inlet means 11 for conveying liquid to the pump, and outlet means 12 for discharging liquid from the pump. The duct 10 is preferably constructed of an electrically conductive material such as copper or aluminum, although other conventional and suitable materials may be used for this purpose.

Inlet 11 is preferably internally placed with regard the circular path formed by duct 10, where the pressure component induced by centrifugal force is minimized. Outlet 12 intersects duct 10 preferably substantially tangential and exterior to the circular path created by duct 10, proximate to and preceding inlet 11 with regard the direction of flow within duct 10. This arrangement permits fluid approaching outlet 12 to be expelled from duct 10 via centrifugal force, such exit being substantially tangential to the circle created by duct 10, since the velocity component of the momentum flow, where the restrictive force of the wall is removed, will be substantially tangential to duct 10.

Arranged within duct 10 is the impeller element comprising three iron cores, C1, C2, and C3. As shown more particularly in FIG. 11, each iron core is connected releasably one to the other by core connectors 13, 14 and 15, and each include nylon impeller tip portions 16, 17 and 18. Each tip portion is arcuately shaped for the purpose of diverting the flow of liquid within duct 10 from outlet 12 in a tangential direction with respect to the centerline of the duct 10. These arcuate tip impeller portions 16–18 of each core element overcome any tendency of the liquid in duct 10 to follow a circumferential path about the duct 10 at or adjacent the outlet 12. The core connectors 13–15 are constructed of a steel alloy whereas the impeller tips 16–18 are of a hard but flexible material such as nylon, polyethylene, polypropylene, or polyvinylchloride. Cores C1 to C3 are of a ferromagnetic material.

A housing 19 is provided for duct 10 in the area of inlet 11 and outlet 12, and extending a short distance donwstream thereof. Housing 19 is preferably in two parts, with only the bottom portion shown in FIG. 1. A similar mating upper housing half section (not shown) is provided in order that access may be had to the inner confines of duct 10 in order to change or repair the various impeller elements therein. Any heat resistant material, metal or plastic, may be employed in the construction of housing 19.

With reference again to FIG. 1, there will be seen solenoids W1, W2 and W3, of curvilinear shape and concentric with and in surrounding relationship to duct 10. The solenoid specifics are shown in FIG. 12 and there will be seen one of the cores C3 partially disposed therein and surrounded by the brass sleeve of duct 10. An insulated winding 30 is illustrated along with the iron-clad sheath 32. It should be noted that each of solenoids W1–W3 of FIG. 1 possess the construction illustrated in more detail in FIG. 12.

The signals from sensors S1, S2, and S3 are transmitted via leads 22, to control circuitry FIG. 15, described in greater detail below. Sensors S1, S2, and S3 detect the location of cores C1, C2, and C3 within duct 10 for selectively energizing solenoids W1, W2, and W3 in a sequence effective to maintain movement of the impeller element in a predetermined direction.

As noted hereinbefore, when the solenoid is energized, the core becomes magnetized and the mutual action of the field in the solenoid on the poles created on the core causes that core to move within that particular solenoid.

In FIG. 1, there is also shown sensors S1, S2 and S3. Each sensor is of the construction more particularly detailed in FIG. 13. The heart of the sensor is an oscillator 20 which radiates a sensing field. The oscillator is located within screw threaded housing 21 and suitable leads 22 are provided. When a metallic object enters the sensing field, eddy currents are induced in the target. This affects the internal impedance of the oscillator 20 which provides a useable signal output via leads 22. The target or object in the instant case is the iron core C1–C3 which constitute the impeller unit of the pump of the present invention. The sensors S1–S3 are epoxy potted and thus impervious to most liquids. As seen in detail in FIG. 14, duct 10 includes a threaded female connector 23 for receiving the oscillator end 21 of the sensor depicted in FIG. 13.

In addition to the transistor oscillator, the sensor includes a snap-action amplifier to provide high accuracy as to a set switching point even with slowly approaching targets. The switching characteristics are unaffected by the supply voltage. A suitable sensor preferred herein has been found to have a maximum switching distance of from about one to about two mm, a maximum load current of 50 m A, a switching frequency of from 3–5 KHZ, a repeatability of 0.005 mm to 0.01 mm, an operating voltage of 12–28 vdc, ripple max. 10%, quiescent current about 20 m A, hysteresis 3 to 10%, temperature range −13° F. to +158° F, shock 30 g, 11 ms, and vibration 55 HZ, 0.040 amplitude.

Referring now to the operation of the solenoid actuated pump of the present invention, reference is had to FIGS. 1–10 wherein there is shown a single revolution of the core C3 from its starting position as seen in FIG. 1, clockwise in movement in FIGS. 2–9, and back to its starting position in FIG. 10. Since it should be apparent that this cycle is repetitive over and over again in the pumping action, only one cycle of revolution of core C3 will be traced herein for illustrative purposes.

In FIG. 1, sensor S1 actuates winding W1 by virtue of the interaction of core C3 with sensor S1. Entry of core C3 (or the target) in the sensing field of sensor S1 provides a signal that de-energizes solenoid W2 which causes core C1 to be pulled into solenoid W1.

Figure 2:
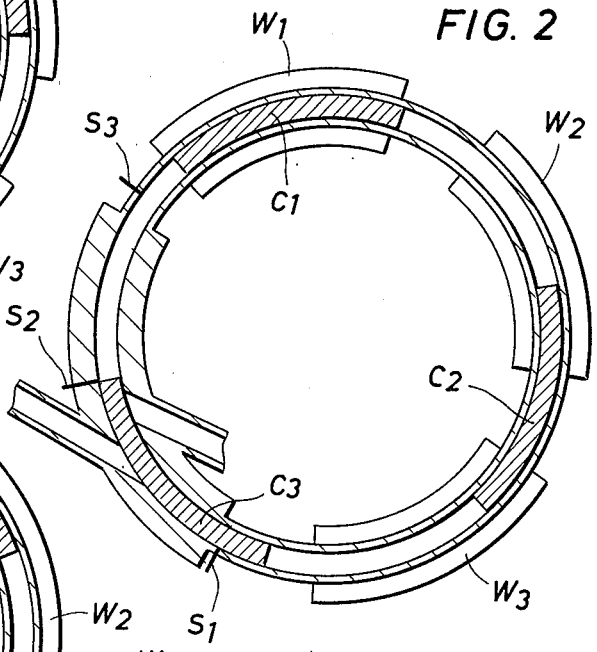

In FIG. 2, sensor S2 actuates winding W3 by virtue of the interaction of core C3 with sensor S2. Entry of core C3 (or the target) in the sensing field of sensor S2 provides a signal that de-energizes solenoid W1 which causes core C2 to be pulled into solenoid W3.

Figure 3:
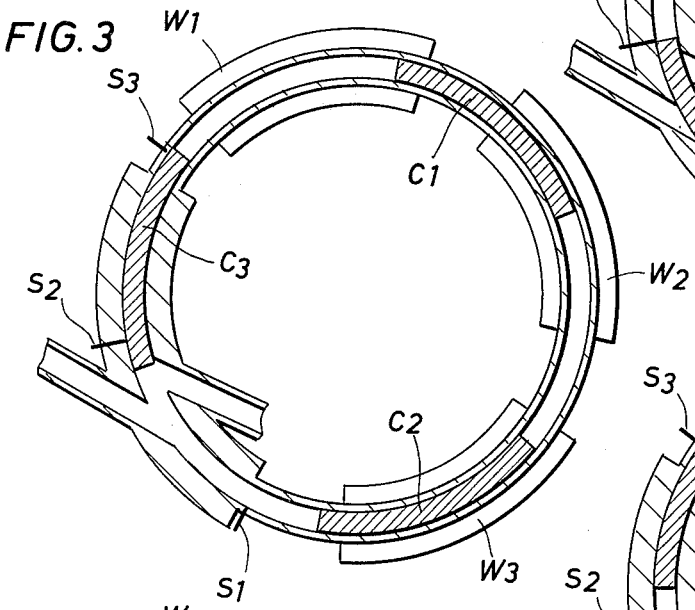

In FIG. 3, sensor S3 actuates winding W2 by virtue of the interaction of core C3 with sensor S3. Entry of core C3 (or the target) in the sensing field of sensor S3 provides a signal that de-energizes solenoid W3 which causes core C1 to be pulled into solenoid W2.

Figure 4:
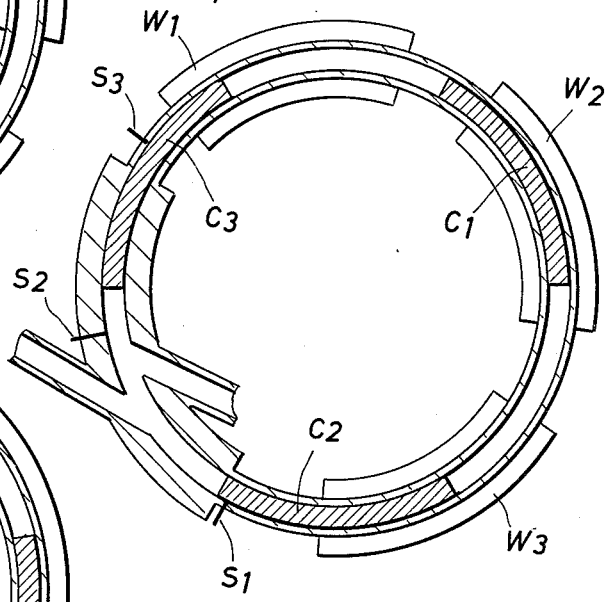

In FIG. 4, sensor S1 actuates winding W1 by virtue of the interaction of core C2 with sensor S1. Entry of core C2 (or the target) in the sensing field of sensor S1 provides a signal that de-energizes solenoid W2 which causes core C3 to be pulled into solenoid W1.

Figure 5:
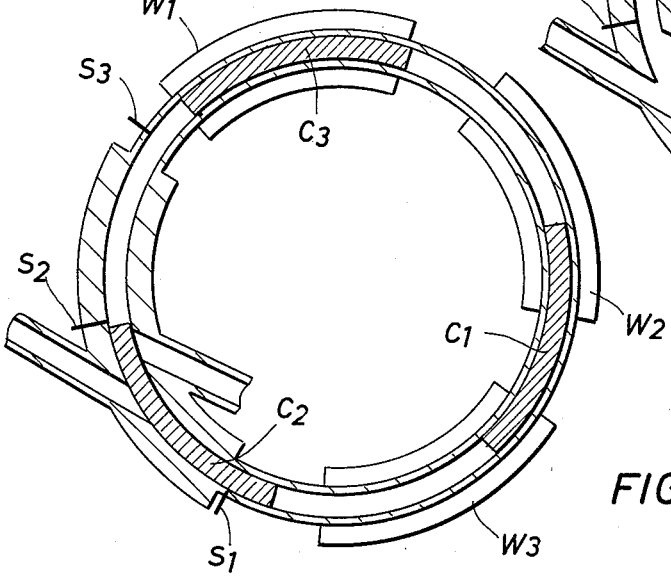

In FIG. 5, sensor S2 actuates winding W3 by virtue of the interaction of core C2 with sensor S2. Entry of core C2 (or the target) in the sensing field of sensor S2 provides a signal that de-energizes solenoid W1 which causes core C1 to be pulled into solenoid W3.

In FIG. 6, sensor S3 actuates winding W2 by virtue of the interaction of core C2 with sensor S3. Entry of core C2 (or the target) in the sensing field of sensor S3 provides a signal that de-energizes solenoid W3 which causes core C3 to be pulled into solenoid W2.

In FIG. 7, sensor S1 actuates winding W1 by virtue of the interaction of core C1 with sensor S1. Entry of core C1 (or the target) in the sensing field of sensor S1 provides a signal that de-energizes solenoid W2 which causes core C2 to be pulled into solenoid W1.

In FIG. 8, sensor S2 actuates winding W3 by virtue of the interaction of core C1 with sensor S2. Entry of core C1 (or the target) in the sensing field of sensor S2 provides a signal that de-energizes solenoid W1 which causes core C3 to be pulled into solenoid W3.

In FIG. 9, sensor S3 actuates winding W2 by virtue of the interaction of core C1 with sensor S3. Entry of core C1 (or the target) in the sensing field of sensor S3 provides a signal that de-energizes solenoid W3 which causes core C2 to be pulled into solenoid W2.

In FIG. 10, sensor S1 actuates winding W1 by virtue of the interaction of core C3 with sensor S1. Entry of core C3 (or the target) in the sensing field of sensor S1 provides a signal that de-energizes solenoid W2 which causes core C1 to be pulled into solenoid W1.

Thus, there is seen a sequence of operation as above described for one complete cycle of the core elements C1–C3 within duct 10. This cycle is repeated over and over again resulting in fluid being discharged at outlet 12. Circuitry for effecting the coaction and interaction of the above described components of the pump will be set forth hereinafter with reference to FIG. 15 in greater detail.

In light of the above, and in order to further simplify and exemplify the concepts and features of the present invention, the following Tables are set forth tabulating the effects noted hereinabove with respect to FIGS. 1–10.

TABLE I

| | SOLENOID ACTUATION | | |
|---|---|---|---|
| FIG. | W1 | W2 | W3 |
| 1 | ON | OFF | OFF |
| 2 | OFF | OFF | ON |
| 3 | OFF | ON | OFF |
| 4 | ON | OFF | OFF |
| 5 | OFF | OFF | ON |
| 6 | OFF | ON | OFF |
| 7 | ON | OFF | OFF |
| 8 | OFF | OFF | ON |
| 9 | OFF | ON | OFF |
| 10 | ON | OFF | OFF |

TABLE II

| FIG. | CORE LOCATION W1 | W2 | W3 |
|---|---|---|---|
| 1 | C1 | — | — |
| 2 | — | — | C2 |
| 3 | — | C1 | — |
| 4 | C3 | — | — |
| 5 | — | — | C1 |
| 6 | — | C3 | — |
| 7 | C2 | — | — |
| 8 | — | — | C3 |
| 9 | — | C2 | — |
| 10 | C1 | — | — |

TABLE III

| FIG. | CORE SENSED S1 | S2 | S3 |
|---|---|---|---|
| 1 | C3 | — | — |
| 2 | — | C3 | — |
| 3 | — | — | C3 |
| 4 | C2 | — | — |
| 5 | — | C2 | — |
| 6 | — | — | C2 |
| 7 | C1 | — | — |
| 8 | — | C1 | — |
| 9 | — | — | C1 |
| 10 | C3 | — | — |

With respect to FIG. 15 and to the electrical circuitry depicted therein, there will be seen a diagram for control circuitry affecting the pump movement hereinabove described. In a typical operational sequence, as a core approaches sensor S1, a core will be already in position adjacent switch S3. Thus, switch S3 will close energizing coil CR3. Energizing coil CR3 closes the normally open contacts and relay CR3 energizing winding W2. The normally closed contact and relay CR3 is open, de-energizing relay coil CR2 and winding W3. Thus, at the beginning, only winding W2 is energized.

As a core is sensed by sensor S1, sensor S1 closes, energizing relay coil CR1. The normally open CR1 contact closes, energizing winding W1 while the normally closed contact CR1 opens, de-energizing relay coil CR3 and de-energizing winding W2. Thus, only winding W3 is energized continuing rotating the cores interiorly of the windings. It should be noted that the core adjacent sensor S3 has now moved and sensor S3 is now open.

As the core adjacent sensor S1 continues its rotation, it approaches sensor S2, activating sensor S2 and energizing control relay 2. Control relay 2 closes the normally open contacts of relay CR2, energizing winding W3. The normally closed contacts CR2 are now open, de-energizing control relay 1 and de-energizing winding 1. Thus, only winding 3 is activated at this time.

Thus, it may be seen that the control circuitry hereinabove described acts to actuate only one control winding at a time thereby moving the cores continuously through the windings. The energizing of one winding results in de-energizing the previously energized winding to provide an electric field and electromagnetic forces acting on the rotating cores to move the cores only in the desired direction while minimizing restraining forces on cores moving out of many windings. As hereinabove described, the above sequence is repeated three times during a 360° revolution of a single core.

SUMMARY OF THE CIRCUIT OPERATION

It should be noted that in FIG. 15, three control relays, CR1, CR2 and CR3 are provided. Each relay includes a coil denoted by the reference designation CR1, 2 or 3 in a circle, a normally closed contact pair, and a normally open contact pair respectively represented by the conventional symbols therefore. Each of the windings W1, W2 and W3 is connected with one normally open contact pair. Winding W1 is connected in a series with normally open contact pair CR1; winding W2 is connected in a series with normally open contact pair CR3; and winding W3 is connected in a series with normally open contact pair CR2. These three series arrangements are all connected across a power source. Selective closing of a contact pair CR1, CR2, or CR3 to energize a winding W1, W3 or W2 respectively is achieved in the following manner. The relay coil CR1 is connected in a series with the normally closed contact pair CR2 and sensor switch S1. The relay coil CR2 is connected in series with the normally closed contact pair CR3 and the sensor switch S2. The relay coil CR3 is connected in a series with the normally closed contact pair CR1 and sensor switch S3. As described above, the sensor S illustrated in FIG. 13 functions as switches, and are therefore, illustrated as such in FIG. 15. All three of the last recited series arrangements are connected in series with a Stop switch and across the power source. The Stop switch is an on-off switch which is close to enable operation of the present apparatus.

When the sensor-switch S1 senses a ferromagnetic core member C1, C2 or C3, the switch S1 seen in FIG. 15 closes to complete the circuit through normally closed contact CR2 to connect the winding CR1 across the power source. When the winding CR1 is energized, the states of the contacts CR1 change from their normal state. Consequently, normally open contacts CR1 close and energize winding W1. At the same time, normally closed contacts CR1 open to denergize coil CR3. (Assuming the operating cycle is continuing, and, as seen particularly in FIG. 6, sensor S3 would have been operated, i.e. switch S3 would have been closed, prior to operation of switch S1.) Normally open contacts CR3 return from a closed to their normally open state, and the winding W2 is denergized. Each series combination including a winding is operated in the same manner.

Inlet and outlet means 11 and 12 may be provided with uni-directional check valves (not illustrated) for the purpose of establishing proper fluid flow into and out of the duct 10, if desired.

It will be apparent from the foregoing that many other variations and modifications may be made in the structures and methods described herein without departing substantially from the essential concept of the present invention. Accordingly, it should be clearly understood that the forms of the invention described herein and depicted in the accompanying drawings are exemplary only and are not intended as limitations in the scope of the present invention.

What is claimed is:

1. A centrifugal pump comprising:

a circular closed loop conduit;

a fluid outlet intersecting said conduit and providing an outlet path exterior of a circle defined by the conduit;

a fluid inlet intersecting said conduit means and being displaced from said outlet in a first direction of travel along an arc defined by said conduit, said inlet directing fluid into said conduit means from a direction interior of the circle defined by the conduit;

an impeller within said conduit and including at least first and second ferromagnetic core members angularly displaced therefrom;

electromagnetic means in surrounding relationship to said conduit, said electromagnetic means including at least first and second windings angularly displaced with respect to spacing between said at least first and second ferromagnetic core members for inducing unidirectional rotation of said impeller in response to energization of said windings in a preselected sequence; and means for energizing said windings in the preselected sequence.

2. The pump according to claim 1 wherein said means for energizing said windings comprises at least first and second proximity sensors angularly displaced with respect to said electromagnetic core members for sensing angular displacement of one said core member with respect to a winding to be energized.

3. The pump according to claim 2 wherein said impeller comprises first, second and third curvilinear magnetic core members equiangularly spaced-apart and coupled by non-magnetic curvilinear coupling members, said coupling members being proportioned for occupying portions of said conduit occupied by pumped fluid.

4. A solenoid actuated centrifugal pump comprising:

an annular fluid conducting conduit;

a fluid outlet intersecting said conduit means extending to the exterior of the circle defined by conduit and extending along a line parallel to a tangent to the circle;

a fluid inlet upstream with respect to said outlet in a direction of rotation within said conduit, said inlet extending into said conduit means along a line generally parallel to a tangent to the circle and from the interior thereof;

a rotary impeller disposed within said conduit means and including a plurality of connected and spaced-apart arcuate ferromagnetic core members each having a curved forward end in the direction of rotation of said impeller;

a plurality of curvilinear solenoids in surrounding relationship to said conduit means and angularly spaced-apart one from the other for exerting a pole to attract one of said core members; and control means for selectively energizing said windings to urge a first core member from a position angularly displaced from said winding to a position in registration with said winding and sequentially deenergizing said winding and energizing another winding for causing said impeller to rotate in one angular direction.

5. A pump according to claim 4 wherein said means for energizing and deenergizing said windings comprises a plurality of inductive proximity sensors each angularly displaced with respect to the other for selectively energizing the windings.

6. A pump according to claim 5 wherein said rotary impeller comprises arcuate iron core members each having a curved nylon tip at a forward portion, wherein forward is determined with respect to the direction of angular motion of said impeller.

* * * * *